US006034664A

United States Patent [19]

Ali-Santosa et al.

[11] Patent Number: 6,034,664

[45] Date of Patent: Mar. 7, 2000

[54] METHOD AND APPARATUS FOR PSEUDO-RANDOM NOISE GENERATION BASED ON VARIATION OF INTENSITY AND COLORATION

[75] Inventors: Gunawan Ali-Santosa, Milpitas; Marcelino M. Dignum, Menlo Park, both of Calif.

[73] Assignee: Sun Microsystems, Inc., Palo Alto, Calif.

[21] Appl. No.: 08/883,120

[22] Filed: Jun. 25, 1997

[51] Int. Cl.[7] ..... G09G 5/02

[52] U.S. Cl. ..... 345/150; 345/149; 345/151; 345/152

[58] Field of Search ..... 345/149, 147, 345/150, 151, 152, 153, 154, 155; 358/457, 458

[56] References Cited

U.S. PATENT DOCUMENTS

| | | | |
|---|---|---|---|
| 4,794,531 | 12/1988 | Morishita et al. | 364/413.13 |
| 4,956,638 | 9/1990 | Larky et al. | 345/199 |
| 4,977,458 | 12/1990 | Granger et al. | 358/456 |
| 4,997,733 | 3/1991 | Carleer et al. | 430/7 |
| 5,059,962 | 10/1991 | Sekiya | 340/793 |
| 5,201,030 | 4/1993 | Carrie | 395/132 |
| 5,455,600 | 10/1995 | Friedman et al. | 345/153 |
| 5,469,190 | 11/1995 | Masterson | 345/155 |
| 5,469,536 | 11/1995 | Blank | 395/131 |
| 5,495,346 | 2/1996 | Choi et al. | 358/457 |
| 5,513,016 | 4/1996 | Inoue | 358/456 |
| 5,548,305 | 8/1996 | Rupel | 345/150 |
| 5,598,184 | 1/1997 | Barkans | 345/149 |
| 5,649,083 | 7/1997 | Barkans et al. | 345/147 |
| 5,790,165 | 11/1996 | Kuboki et al. | 347/251 |
| 5,821,913 | 12/1995 | Mamiya | 345/88 |
| 5,830,064 | 11/1998 | Bradish et al. | 463/22 |

OTHER PUBLICATIONS

Foley, et al., "Computer Graphics, Princples and Practice", 1990, Addison–Wesley Publishing Company, Second Edition, pp. 568–573.

*Primary Examiner*—Richard A. Hjerpe
*Assistant Examiner*—Marthe Y. Marc-Coleman
*Attorney, Agent, or Firm*—D'Alessandro & Ritchie

[57] ABSTRACT

A method and apparatus for dithering for color computer display systems includes the addition of a noise component to each of the color components of each pixel in a pseudo-random manner. The noise component is preferably different for each color component. Taking the image as a whole, the noise component repeats on a regular basis but is preferably selected so as not to repeat on adjacent pixels. The image is divided into squares of pixels and the same noise component is added to each of the same relative pixels from square to square. The preferred square of pixels is four pixels wide by four pixels high. The value of the noise component is chosen such that the most significant bit alternates both horizontally and vertically from pixel to pixel within the square of pixels. The other bits of the value of the noise component are preferably chosen such that the value of the noise component does not repeat within the square of pixels and such that a simplified hardware implementation is made possible by their selection. The resulting hardware implementation preferably consists of a number of exclusive-or gates tied together to produce the value of the noise component based on the least significant bits of the X and Y coordinates of each pixel. This hardware implementation is simple enough that it becomes economically practical to add a different noise component to each of the three color components of each pixel rather than the same noise component to all of the color components.

24 Claims, 2 Drawing Sheets

N3

| | | | |
|---|---|---|---|
| 1 | 0 | 1 | 0 |
| 0 | 1 | 0 | 1 |
| 1 | 0 | 1 | 0 |
| 0 | 1 | 0 | 1 |

N3

| | | | |
|---|---|---|---|
| 1 | 0 | 1 | 0 |
| 0 | 1 | 0 | 1 |
| 1 | 0 | 1 | 0 |
| 0 | 1 | 0 | 1 |

FIG. 1

N1

| | |
|---|---|
| 1 | 0 |
| 0 | 1 |

FIG. 2

N7

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |

FIG. 3

N3

| | | | |
|---|---|---|---|
| 0 | 1 | 0 | 1 |
| 1 | 0 | 1 | 0 |
| 0 | 1 | 0 | 1 |
| 1 | 0 | 1 | 0 |

FIG. 4

N2

| | | | |
|---|---|---|---|
| 1 | 1 | 0 | 0 |
| 1 | 1 | 0 | 0 |
| 0 | 0 | 1 | 1 |
| 0 | 0 | 1 | 1 |

FIG. 5

| | | | |
|---|---|---|---|
| 0 | 1 | 0 | 1 |
| 1 | 0 | 1 | 0 |
| 1 | 0 | 1 | 0 |
| 0 | 1 | 0 | 1 |

N0

| | | | |
|---|---|---|---|
| 0 | 0 | 1 | 1 |
| 1 | 1 | 0 | 0 |
| 1 | 1 | 0 | 0 |
| 0 | 0 | 1 | 1 |

| | | | |
|---|---|---|---|
| C | 6 | 9 | 3 |
| 7 | D | 2 | 8 |
| B | 1 | E | 4 |
| 0 | A | 5 | F |

METHOD AND APPARATUS FOR PSEUDO-RANDOM NOISE GENERATION BASED ON VARIATION OF INTENSITY AND COLORATION

RELATED APPLICATION DATA

Co-pending application Ser. No. 08/883,260 (attorney docket number SUNP-2531), is filed tie same day as this application, and is Entitled "METHOD AND APPARATUS FOR PSEUDO-RANDOM N0ISE GENERATION BASED ON VARIATION OF INTENSITY AND COLORATION", by Gunawan Ali-Santosa and Marcelino Dignum, both assignors to Sun Microsystems, a Delaware Corporation.

BACKGROUND OF THE INVENTION

1. Field of the Invention

This invention relates to the field of computer graphics. More specifically, this invention relates to dithering methods for color computer display systems.

2. The Background Art

A computer's display system allows one to receive a continuous visual display from the computer as it works. Because it gives one instant visual feedback, the display system makes the computer interactive. The display system also affects the speed of the computer. Computers use a number of different technologies in creating their displays and the choice determines what one sees, how sharply one sees it, and how quickly one sees it.

The predominant choices for seeing things that come from a computer today are the cathode ray tube (CRT) display and the flat panel liquid crystal display (LCD). The screen of the display is divided up into a systematic pattern of picture elements commonly called pixels. One pixel represents the smallest building block from which an image can be constructed on the display. The number that quantifies the possible sharpness of an image is called resolution. It indicates how many individual pixels an image contains across the width and height of the screen. Resolution is generally quantified as the number of pixels per horizontal line and the number of horizontal lines per screen. For example, a common computer display has a resolution of 1024×768.

A common way to construct an image to be displayed is to store an electronic representation of the image in a block of memory. Under some schemes, this is a dedicated block of memory referred to as graphic display memory. Under other schemes, the image is stored in a block of main memory. In either case, this block of memory is constantly being updated by the software in the computer and represents a time-slice of what is seen on the screen. This block of memory temporarily stores or buffers the changes in the image until it is read out as a complete image frame dozens of times per second. Because of this function, this block of memory is often called the frame buffer. Most applications write directly to the frame buffer rather than to the screen to achieve satisfactory performance.

For computer displays, each pixel of an image is commonly electronically represented by five numbers: the X coordinate on the display, the Y coordinate on the display, the red color component, the green color component, and the blue color component. The range of values possible for each of these numbers is limited by the number of bits used in the binary representation of the number. The values of the color components have both an integer and a fractional portion. It is common to refer to color computer display systems that use eight bits for the integer portion of the value of the color components as being "true color."

The coloration of each pixel is determined by the combination of the values of the red, green, and blue color components. The intensity of the color of each pixel is determined by the individual values of the red, green, and blue color components. For example, to render a gray color, the red, green, and blue color components would each be set to the same value. To render a darker gray color, a lower value is used down to a minimum value which will render the color black. To render a lighter gray color, a higher value is used up to the maximum value which will render the color white.

The amount of memory required by the display system depends on two factors: the sharpness of the display image and the number of colors (or gray levels) that are to be displayed. Each increase in sharpness and number of colors means that the computer is putting more detail on the screen and storing more information in its display buffer. This results in longer processing times and/or higher hardware costs. Because of these potential drawbacks, many display systems do not operate using true color.

For instance, in certain scenarios the amount of memory allocated to each of the color components may be limited to four bits. Using four bits results in only sixteen unique color intensity values per color component. For example, the spectrum of colors from black to white will have sixteen steps in it. Unfortunately, this limited range of color intensities can result in unwanted artifacts. For example, at the border between two color values, a discontinuity is detected by the human eye that is known as a mach band.

To combat this artifact, conventional display systems add a noise component to random pixels. The same noise component is added to each of the color components of the selected random pixel. This has the effect of blurring the mach band so that it is less detectable by one's eye. The addition of noise is known as dithering.

However, conventional dithering techniques can suffer from two drawbacks. First, if the dithering technique produces the addition of the same noise component to adjacent pixels, then other undesirable artifacts such as diagonal patterns or dimples may result. Second, if the dithering technique employs a look-up table or cascaded multiplexers, then the cost of the additional hardware may be too high.

OBJECTS AND ADVANTAGES OF THE INVENTION

Accordingly, it is an object of the present invention to minimize the undesirable artifacts of four bit resolution color computer display systems.

It is a further object of the present invention to minimize the hardware costs of four bit resolution color computer display systems.

These and many other objects and advantages of the present invention will become apparent to those of ordinary skill in the art from a consideration of the drawings and ensuing description of the invention.

SUMMARY OF THE INVENTION

A method and apparatus for dithering for color computer display systems includes the addition of a noise component to each of the color components of each pixel in a pseudo-random manner. The noise component is preferably different for each color component. Taking the image as a whole, the noise component repeats on a regular basis but is preferably selected so as not to repeat on adjacent pixels. The image is divided into squares of pixels and the same noise component is added to each of the same relative pixels from square to square. The preferred square of pixels is four pixels wide by four pixels high. The value of the noise component is chosen such that the most significant bit alternates both horizontally and vertically from pixel to pixel within the square of pixels. The other bits of the value of the noise component are preferably chosen such that the value of the noise component does not repeat within the square of pixels and such that a simplified hardware implementation is made possible by their selection. The resulting hardware implementation preferably consists of a number of exclusive-or gates tied together to produce the value of the noise component based on the least significant bits of the X and Y coordinates of each pixel. This hardware implementation is simple enough that it becomes economically practical to add a different noise component to each of the three color components of each pixel rather than the same noise component to all of the color components.

BRIEF DESCRIPTION OF THE DRAWINGS

FIG. 1 is a graphical depiction of a set of most significant bits of the value of the noise components for a four pixel by four pixel embodiment of the present invention.

FIG. 2 is a graphical depiction of a set of most significant bits of the value of the noise components for a two pixel by two pixel embodiment of the present invention.

FIG. 3 is a graphical depiction of a set of most significant bits of the value of the noise components for an eight pixel by eight pixel embodiment of the present invention.

FIG. 4 is a graphical depiction of an alternate set of most significant bits of the value of the noise components for a four pixel by four pixel embodiment of the present invention.

FIG. 5 is a graphical depiction of a set of third bits of the value of the noise components for a four pixel by four pixel embodiment of the present invention.

DESCRIPTION OF THE PREFERRED EMBODIMENTS

Figures 6, 7, 8, 9:
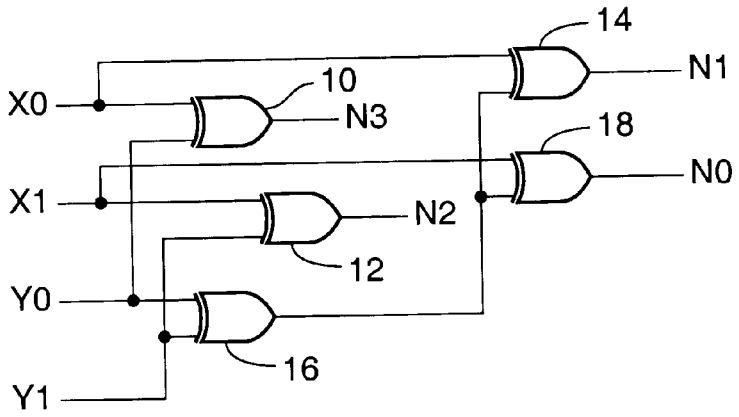
FIG. 6 is a graphical depiction of a set of second bits of the value of the noise components for a four pixel by four pixel embodiment of the present invention.
FIG. 7 is a graphical depiction of a set of least significant bits of the value of the noise components for a four pixel by four pixel embodiment of the present invention.
FIG. 8 is a graphical depiction of a set of hexadecimal values of the noise components for a four pixel by four pixel embodiment of the present invention.
FIG. 9 is a schematic diagram of a hardware implementation of the noise components for a four pixel by four pixel embodiment of the present invention.

Those of ordinary skill in the art will realize that the following description of the present invention is illustrative only and is not intended to be in any way limiting. Other embodiments of the invention will readily suggest themselves to such skilled persons from an examination of the within disclosure.

A dithering method according to the presently preferred invention for color computer display systems consists of the addition of a noise component to each of the color components of each pixel in a pseudo-random manner. Taking the image as a whole, the noise component repeats on a regular basis but is preferably selected so as not to repeat on adjacent pixels. The image is divided into equally sized squares of pixels that are adjacent to each other such that each pixel in the image is associated with one and only one square. Based on these squares, the same noise component is added to each of the same relative pixels from square to square.

The size of the square of pixels can be selected to be any size from a square of two pixels by two pixels up to a square that would encompass every pixel in the image. In the latter case, one of ordinary skill will recognize that since the common image is rectangular then the square of pixels will have more noise components than pixels in the image. The limiting factors in the selection of the size of the square of pixels is the complexity of the design and the resulting hardware implementation. Square sizes that are positive whole number powers of two (i.e. $2^n$, where n is a positive whole number) are easier to implement given a binary environment. The presently preferred square size is four pixels by four pixels which results in sixteen different noise components each of which is preferably four bits long.

In conventional computers that limit the amount of memory allocated for the display system, each pixel of the image to be displayed is calculated using true color but is cut down to fewer bits for display. The noise component is added to the fractional portion of the value of the color component while the color component is still in true color format before it is cut down.

Two hazards of adding a noise component are the situations when the addition of the noise component results in overflow or underflow. In these situations, the resulting color component may be entirely different from the original and result in a visible artifact. To avoid this result, it is necessary to clamp the resulting color component to the maximum or minimum value to prevent overflow or underflow respectively.

In the binary representation of the value of the noise component, the bit that will exhibit the most influence on the look of the resulting image is the most significant bit. In a four bit number, this bit is referred to as N3. The successively lower or lesser significant bits are referred to as N2, N1, and N0 respectively. N0 is referred to as the least significant bit. Because of the influence of the most significant bit, it is preferred that its value in the noise component alternate between a binary value of 1 and 0 from pixel to pixel in both the horizontal and vertical directions. In a four pixel embodiment of the present invention, one possible alternating pattern for the most significant bit or N3 is shown in FIG. 1. One will observe that if the square of FIG. 1 is replicated next to itself in any of the horizontal, vertical, or diagonal directions, the adjacent values of N3 will still alternate from pixel to pixel.

A similar result will occur in a two pixel embodiment of the present invention through the use of the alternating pattern for Ni shown in FIG. 2. FIG. 3 shows the to alternating pattern for N7 in an eight pixel embodiment of the present invention. Those of ordinary skill in the art will be able to readily expand this pattern to any sized square desired. Further, those skilled persons will recognize that the inverse of the patterns of FIGS. 1–3 will also provide an alternating pattern. For example, the inverse of the pattern for the four pixel embodiment of FIG. 1 is shown in FIG. 4. For the discussion that follows, the pattern of FIG. 1 will be assumed to represent the square of values of N3 unless otherwise stated.

The values of the successively lower bits can be chosen as desired. The least desirable image is achieved when the successively lower bits are chosen such that the resulting value of the noise component simply alternates between two values. For example, in a four pixel embodiment of the present invention, the resulting hexadecimal value of the noise component for each pixel could alternate between 0 and 8. This choice however leads to a rather visible checkerboard pattern in the image which is less than ideal. As the number of different resulting noise component values increases, so does the quality of the image. The best image is achieved when the successively lower bits are chosen such that the resulting value of the noise component for each pixel in the square does not repeat within the square. In a four pixel embodiment of the present invention, bits N2, N1, and N0 are chosen so that the resulting hexadecimal value of the noise component for each pixel is different. An example of one choice for each of bits N2, N1, and N0 is shown in FIGS. 5, 6, and 7 respectively. Taken with N3 from FIG. 1, the resulting hexadecimal values of the noise component for each pixel in the square is shown in FIG. 8. Those of ordinary skill in the art will recognize that each of the hexadecimal numbers is used and that none of them repeats. This choice assures that the repeated application of this square to the image will result in the least amount of repetition of the value of the noise component.

The addition of the selected noise component can be performed in an automated manner based on the X and Y coordinates of each pixel in the image. Each of the squares of the bits of the binary representation of the value of the noise component are rearranged into Karnaugh maps (K-maps) and the resulting logic equations are determined from these K-maps. The application of this technique is well known to those of ordinary skill in the art.

For example, the logic equation that results from the K-map of the square of N3 bits shown in FIG. 1 is $$N3=X0.(\sim Y0)+(\sim X0).Y0=X0\hat{}Y0 \quad (1)$$

The logic equations that result from the K-maps of the squares of N2, N1, and N0 bits shown in FIGS. 5, 6, and 7 respectively are $$N2=X1.(\sim Y1)+(\sim X1).Y1=X1\hat{}Y1 \quad (2)$$

$$N1=(\sim X0).(Y0\hat{}Y1)+X0.(\sim(Y0\hat{}Y1))=X0\hat{}(Y0\hat{}Y1) \quad (3)$$

and $$N0=(\sim X1).(Y0\hat{}Y1)+X1.(\sim(Y0\hat{}Y1))=X1\hat{}(Y0\hat{}Y1) \quad (4)$$

respectively.

After determining the logic equations from the K-maps, the least significant bits of the X and Y coordinates of the selected pixel serve as the logic inputs into these equations. For example, the least significant bit of the X coordinate is X0, the next more significant bit is X1, and so on. The least significant bit of the Y coordinate is Y0, the next more significant bit is Y1, and so on. In a four pixel embodiment of the present invention, the logic elements for equations (1) through (4) are X0, X1, Y0, and Y1.

Through the careful selection of the bits of the binary representation of the value of the noise component, relatively simple logic equations can result. A hardware implementation of these simple logic equations is therefore also simple and cost efficient. A schematic diagram of a preferred hardware implementation for a four pixel embodiment of the present invention based on equations (1) through (4) is shown in FIG. 9. As in equation (1), N3 can be seen to be the result of the operation of exclusive-or (XOR) gate 10 on inputs X0 and Y0. As in equation (2), N2 can be seen to be the result of the operation of XOR gate 12 on inputs X1 and Y1. As in equation (3), N1 can be seen to be the result of the operation of XOR gate 14 on input X0 and the result of the operation of XOR gate 16 on inputs Y0 and Y1. As in equation (4), N0 can be seen to be the result of the operation of XOR gate 18 on input X1 and the result of the operation of XOR gate 16 on inputs Y0 and Y1. Those of ordinary skill in the art will recognize that the same logic functions can be performed with other types of logic gates without departing from the inventive concept disclosed herein.

In one dithering method, the same noise component can be added to each of the red, green, and blue color components for a particular pixel. In a preferred dithering method, different noise components are added to each of the red, green, and blue color components for a particular pixel. This will result in a variation of both intensity and coloration. This can be accomplished in a number of ways. For example, a different bit selection for the bits of the square of pixels for the noise component can be made and then added to each of the color components. This however would result in the need for many more logic gates.

A preferred embodiment involves reusing the gates of a single square selection to form different noise components for each of the color components. One way to accomplish this involves the addition of inverters which are relatively inexpensive. The inverter can be used in one of two ways. First, the entire noise output could be inverted from one color component to another. Second, selective ones of the bits of the noise output could be inverted from one color component to another. In a four pixel embodiment of the present invention, the value of the noise component for the red color component can be based on the original value of the bits as N3, N2, N1, and N0. Then the value of the noise component for the green color component could be based on the inverse value of all of the bits as $N3^{-1}$, $N2^{-1}$, $N1^{-1}$, and $N0^{-1}$. Then the value of the noise component for the blue color component could be based on the inverse of only the most significant bit as $N3^{-1}$, N2, N1, and N0. Recall that the inverse of N3 shown in FIG. 1 is shown in FIG. 4.

Another way to accomplish reusing the gates of a single selection to form different noise components for each of the color components is to change the order of the lesser significant bits. The most significant bit must remain the most significant bit because of its strong influence on the final image, but the lesser significant bits can be taken in different orders. In a four pixel embodiment of the present invention, the value of the noise component for the red color component can be based on the bits ordered in the original selected scheme of N3, N2, N1, and N0. Then the value of the noise component for the green color component could be based on the scheme of N3, N1, N2, and N0. Then the value of the noise component for the blue color component could be based on the scheme of N3, N0, N2, and N1.

Those of ordinary skill in the art will recognize that other combinations then those given are possible within the above techniques and that combinations of the above techniques are possible that will result in different noise components being added to each of the red, green, and blue color components for a particular pixel without departing from the concept of the invention disclosed herein.

The dithering method of the present invention minimizes the undesirable artifacts of color computer display systems, avoids other undesirable artifacts of conventional dithering techniques, and minimizes the hardware costs of color computer display systems.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A method of pseudo-random noise generation for a color computer display system comprising:

selecting noise component values for a square of pixels that is at least two pixels high by at least two pixels wide including selecting most significant bits of a binary representation of the noise component values that alternate between one and zero in both the horizontal and vertical directions;

determining logic operations related to each of the bits of the binary representation of the noise component values;

determining a first specific noise component value for a selected pixel by application of the logic operations to at least the least significant bit of the binary representation of the X and Y coordinates of the selected pixel; and adding the first specific noise component value to at least one of the color components of the selected pixel.

2. The method of claim 1 further comprising adding the first specific noise component value to a second and a third of the color components of the selected pixel.

3. The method of claim 1 further comprising:

inverting at least one of the bits of the binary representation of the first specific noise component value to determine a second specific noise component value; and adding the second specific noise component value to at least a second of the color components of the selected pixel.

4. The method of claim 3 wherein the square of pixels is at least three pixels high by at least three pixels wide, said method further comprising:

swapping at least two of the lesser significant bits of the binary representation of the second specific noise component value to determine a third specific noise component value; and adding the third specific noise component value to a third of the color components of the selected pixel.

5. The method of claim 3 wherein said inverting comprises inverting an odd number of bits.

6. The method of claim 3 wherein said inverting comprises inverting an even number of bits.

7. The method of claim 3 wherein said inverting comprises inverting the most significant bit.

8. The method of claim 3 wherein said inverting comprises inverting the least significant bit.

9. The method of claim 1 further comprising:

inverting all of the bits of the binary representation of the first specific noise component value to determine a second specific noise component value; and adding the second specific noise component value to at least a second of the color components of the selected pixel.

10. The method of claim 1 wherein the square of pixels is at least three pixels high by at least three pixels wide, said method further comprising:

swapping at least two of the lesser significant bits of the binary representation of the first specific noise component value to determine a second specific noise component value; and adding the second specific noise component value to at least a second of the color components of the selected pixel.

11. The method of claim 10 further comprising:

inverting at least one of the bits of the binary representation of the second specific noise component value to determine a third specific noise component value; and adding the third specific noise component value to a third of the color components of the selected pixel.

12. The method of claim 11 wherein said inverting at least one of the bits of the binary representation of the second specific noise component value comprises inverting an odd number of bits.

13. The method of claim 11 wherein said inverting at least one of the bits of the binary representation of the second specific noise component value comprises inverting an even number of bits.

14. The method of claim 11 wherein said inverting at least one of the bits of the binary representation of the second specific noise component value comprises inverting the most significant bit.

15. The method of claim 11 wherein said inverting at least one of the bits of the binary representation of the second specific noise component value comprises inverting the least significant bit.

16. The method of claim 10 wherein said inverting comprises inverting an odd number of bits.

17. The method of claim 10 wherein said inverting comprises inverting an even number of bits.

18. The method of claim 10 wherein said inverting comprises inverting the most significant bit.

19. The method of claim 10 wherein said inverting comprises inverting the least significant bit.

20. The method of claim 1 wherein said selecting noise component values further comprises selecting lesser significant bits of the binary representation of the noise component values such that the noise component values do not repeat within the square of pixels.

21. The method of claim 1 wherein said adding results in at least one dithered color component of the selected pixel and said method further comprises clamping the at least one dithered color component to a maximum value on condition of overflow.

22. The method of claim 1 wherein said determination of a first specific noise component value applies said logic operations to the least significant bit of the binary representation of the X and Y coordinates of the selected pixel.

23. The method of claim 1 wherein said determination of a first specific noise component value applies said logic operations to the two least significant bits of the binary representation of the X and Y coordinates of the selected pixel.

24. A method of pseudo-random noise generation for a color computer display system comprising:

selecting noise component values for a square of pixels that is four pixels high by four pixels wide comprising:

selecting most significant bits of a binary representation of the noise component values that alternate between 1 and 0 in both the horizontal and vertical directions; and selecting lesser significant bits of the binary representation of the noise component values such that the noise component values do not repeat within the square of pixels;

determining logic operations related to each of the bits of the binary representation of the noise component values;

determining a first specific noise component value for a selected pixel by application of the logic operations to the two least significant bits of the binary representation of the X and Y coordinates of the selected pixel;

adding the first specific noise component value to at least one of the color components of the selected pixel resulting in at least one dithered color component; and clamping the at least one dithered color component to a maximum value on condition of overflow.

* * * * *